US008729801B2

(12) United States Patent
Fransson

(10) Patent No.: US 8,729,801 B2
(45) Date of Patent: May 20, 2014

(54) ENVIRONMENTALLY FRIENDLY METAL HALOGEN LAMP COMPRISING BURNER MADE OF QUARTZ GLASS OR CERAMIC GLASS

(75) Inventor: Martin Fransson, Hallabro (SE)

(73) Assignee: Auralight International AB (SE)

( * ) Notice: Subject to any disclaimer, the term of this patent is extended or adjusted under 35 U.S.C. 154(b) by 0 days.

(21) Appl. No.: 13/501,619

(22) PCT Filed: Oct. 8, 2010

(86) PCT No.: PCT/SE2010/051091

§ 371 (c)(1),
(2), (4) Date: Jun. 29, 2012

(87) PCT Pub. No.: WO2011/046496

PCT Pub. Date: Apr. 21, 2011

(65) Prior Publication Data

US 2012/0262060 A1 Oct. 18, 2012

(30) Foreign Application Priority Data

Oct. 12, 2009 (SE) ..... 0950752

(51) Int. Cl.
*H01J 17/16* (2012.01)
*H01J 11/00* (2012.01)
*H01J 17/00* (2006.01)

(52) U.S. Cl.
USPC ..... 313/634; 313/567; 313/635; 313/637

(58) Field of Classification Search
None
See application file for complete search history.

(56) References Cited

U.S. PATENT DOCUMENTS

| | | | | |
|---|---|---|---|---|
| 5,144,201 | A | 9/1992 | Graham et al. | |
| 6,815,893 | B2 * | 11/2004 | Kakisaka et al. | 313/634 |
| 7,414,368 | B2 * | 8/2008 | Rintamaki et al. | 313/637 |
| 8,030,847 | B2 * | 10/2011 | Haacke et al. | 313/634 |
| 2003/0080681 | A1 | 5/2003 | Kakisaka et al. | |
| 2008/0278078 | A1 | 11/2008 | Uemura et al. | |
| 2009/0153053 | A1 | 6/2009 | Podevels | |

FOREIGN PATENT DOCUMENTS

| | | | |
|---|---|---|---|
| JP | 58-80257 | A | 5/1983 |
| JP | 8-148121 | A | 6/1996 |
| WO | WO-2008/110967 | A1 | 9/2008 |
| WO | WO-2011/046496 | A1 | 4/2011 |

OTHER PUBLICATIONS

"International Application Serial No. PCT/SE2010/051091, International Search Report mailed Oct. 28, 2010", 3 pgs.

(Continued)

*Primary Examiner* — Natalie Walford
(74) *Attorney, Agent, or Firm* — Schwegman Lundberg & Woessner, P.A.

(57) ABSTRACT

The invention relates to a metal halogen lamp comprising an elongated arc tube enclosed in a transparent casing, wherein the arc tube is made up of a hollow glass body comprising two end portions and a middle portion, and electrode is arranged on the respective end portion, which electrodes, each having an electrode end, upon connection to a power source and during operation of the metal halogen lamp, generate an arc between them; and the glass body encloses halogens (h) and metal atoms (m) and has a wall thickness which is thicker on the end portions than on the middle portion. The thicker end portions each have a length (L1) of at least one-third of the total length (L) of the arc tube.

8 Claims, 3 Drawing Sheets

(56) References Cited

OTHER PUBLICATIONS

Tambini, J., et al., "Extension of ceramic metal halide technology to lower wattages", *Tenth International Symposium on the Science and Technology of Light Sources. Light Sources 2004*, (2004), 585-586.
"European Application Serial No. 10823692.8, Supplementary European Search Report mailed Aug. 12, 2013", 12 pgs.
"International Application Serial No. PCT/SE2010/051091, International Preliminary Report on Patentability dated Apr. 17, 2012", 6 pgs.
"International Application Serial No. PCT/SE2010/051091, Written Opinion mailed Oct. 28, 2010", 5 pgs.

* cited by examiner

ENVIRONMENTALLY FRIENDLY METAL HALOGEN LAMP COMPRISING BURNER MADE OF QUARTZ GLASS OR CERAMIC GLASS

RELATED APPLICATIONS

This application is a nationalization under 35 U.S.C. §371 from International Application Serial No. PCT/SE2010/051091, filed Oct. 8, 2010 and published as WO 2011/046496 A1 on Apr. 21, 2011, which claims the priority benefit of Sweden Application Serial No. 0950752-6, filed Oct. 12, 2009, the contents of which applications and publication are incorporated herein by reference in their entirety.

TECHNICAL FIELD

The present invention relates to a metal halogen lamp according to the preamble to Patent Claim 1.

The invention concerns the manufacturing industry for ceramic metal halogen lamps, which are designed to be able to deliver the greatest possible light quantity for as long a time as possible and which are environmentally friendly.

BACKGROUND ART

The working principle of a metal halogen lamp is that an arc is created between two electrodes enclosed in a burner glass tube (arc tube). The arc is generated by a mixture of suitable gases for emitting light. The burner glass tube is configured as compactly as possible, accommodating as large a part of the said gases as possible for consumption during operation. The burner glass tube is produced in elongated form with an electrode at each end and is expediently placed inside a closed space formed by a transparent glass body. In traditional metal halogen lamps, the burner contains a mixture of gases such as argon, mercury and metal halogens. The argon gas, through its ionization, enables the arc to be ignited when current is transported between the electrodes. The heat which is formed by the arc will then vaporize the mercury and the metal halogens. These vaporized metals produce light when the pressure is raised and the temperature rises in the burner.

During operation, in a first step, metal atoms move from the arc in the direction of the wall of the colder burner tube in which the halogens are found. On the wall, the metals and the halogens form stable molecules which do not corrode the burner tube. The formation takes place as a result of the formed vapour pressure and the increased temperature. When the metal halogens approach the arc again, the molecules will be broken up, whereby the halogens move away from the arc and the metal atoms remain in the arc and generate light. After this, the first step is started anew and the metal atoms move from the arc towards the halogens on the wall to form molecules, etc.

In certain cases, molecules of halogens and metal atoms are not formed, whereby the metal atoms will diffuse out through the wall of the burner tube. The fewer metal atoms there are in the burner tube, the worse is the production of light.

U.S. 2009/0153053 describes a metal halogen lamp having low mercury content in order to produce a more environmentally friendly lamp. The burner therefore comprises a content of zinc metal or zinc. The document describes that the length of the burner tube is directly proportional to the power consumption, whereby the length can be increased (make the burner tube longer and narrower) and thus the mercury vapour pressure reduced and the mercury component reduced. This gives an environmentally friendly lamp.

WO 2006/078632 A1 describes a metal halogen lamp of ceramic material with good light projection. The lamp which is described there is configured with a burner in three parts, having an intermediate tube part as well as two plug parts insertable in each end of the intermediate tube part and extending into the intermediate tube part by a distance substantially corresponding to the length of the electrode. Various types of gases are described to reduce erosion of the ceramic material in the tube part. At least two-fifths (40%) in total of the internal length of the burner tube are designated as a central region of the burner tube, which central region has a thinner wall thickness than the end portions of the burner tube with the insertable plug portions. Each thicker-walled end portion of the burner tube thus has a length of 30% or less of the total length of the burner tube. The burner tube likewise has an internally arranged step within the region of the transition between the intermediate tube part and the respective plug part.

SUMMARY OF INVENTION

One way of solving the problem of extending the operating time for the metal halogen lamp is to put in more halogens (by pumping) in the production of the burner tube. However, the wall of the burner tube would then erode to a greater degree, whereby the metal atoms would more easily diffuse through the wall and the problem would remain.

There is therefore a need to be able to provide a metal halogen lamp, comprising a burner made of ceramic glass, which is environmentally friendly and has a long operating time. The metal halogen lamp is also required to be able to be produced in as compact a form as possible.

The object of the invention is in large part to extend the working life, since metal halogen lamps, unlike conventional fluorescent lamps, traditionally have a life of 25% of these latter.

The object is likewise to provide a metal halogen lamp which can be arranged in as compact a fitting as possible, since traditional fittings for present-day metal halogen lamps can appear far too large.

A further object of the invention is to eliminate drawbacks of the prior art.

DISCLOSURE OF INVENTION

The abovementioned objects have been achieved by means of the metal halogen lamp defined in the introduction, having the characteristics defined in the characterizing part of Patent Claim 1.

In this way, the operating time has been increased and the lamp does not need to be exchanged as often, which is environmentally friendly, since the thicker wall of the glass body within the region of the electrodes prevents free metal atoms, to a greater degree than the prior art, from being able to migrate through the wall of the glass body during operation of the lamp. The middle portion can at the same time be produced thinner than the end portions, which gives a cost-effective production, since the material costs for arc tubes are generally high. The arc tube can thus also at the same time be produced with lower weight. Because of the thicker wall, any metal atoms which are not bonded to halogens during the operation of the lamp find it more difficult to diffuse out from the arc tube. Since the molecules consisting of metal atoms and halogens are broken up to a greater degree in the vicinity of the electrode ends due to the higher temperature produced there and the vapour pressure, separate metal atoms, which do not form stable molecules with the halogens, are found to a greater degree by the end of the electrode. The Applicant has noted in experiments that, by producing the wall of the glass body thicker on the end portions, in which the length of the respective thicker end portion is at least ⅓ of the total length of the arc tube, and the thicker end portion clearly extends farther than (in the direction away from the end portion towards the middle portion) the electrode end and thoroughly encloses this, any free metal atoms not bonded to the halogens are more widely prevented from diffusing out from the arc tube. By thereby detaining free metal atoms in the arc tube, the working life of the metal halogen lamp can be extended in comparison to the prior art. The metal atoms are important for the production of light when they are energized in the arc before they form the stable molecules in the vicinity of the wall of the glass body. The Applicant has thus noted that this incomplete formation of molecules can occur, above all, within the region of the electrodes and in the vicinity of the electrodes on the wall of the glass body. By increasing the working life of the arc tube, the metal halogen lamp can alternatively be produced with a smaller arc tube, with a working life corresponding to present-day metal halogen lamps, whereby the transparent casing itself (the glass bulb of the lamp) and the associated cap can be made less bulky, which is advantageous when the metal halogen lamp is fitted in a visually compact and hence aesthetically pleasing fitting.

Preferably, the end portions each have a length of around 40% of the total length of the arc tube.

Free metal atoms are hence guaranteed with great certainty not to diffuse through the wall of the glass body.

Alternatively, the hollow glass body is plane and thickening of the end portions is realized on the outer side of the glass body.

Pockets or steps inside the arc tube, which otherwise accumulate the metal atoms and/or halogens in the vicinity of the electrode end, are thus avoided. Due to the higher temperature and the vapour pressure there, such an accumulation would cause a more widespread diffusion of metal atoms out through the wall of the glass body, which would shorten the working life of the metal halogen lamp.

Preferably, the respective electrode end is placed such that an imaginary line between the electrode end and the region of the glass body defined by the transition between the end portion and the middle portion intersects the centre line of the arc tube at an angle of 25-50 degrees, preferably 30-45 degrees.

It is thereby guaranteed that any metal atoms not bonded with the halogens find it harder to diffuse out through the wall of the glass body in the vicinity of the electrode end during operation of the metal halogen lamp, but these metal atoms, due to the thicker end portions, instead tend to stay in the arc tube when, having left the hotter arc adjacent to the electrode end, they seek to form molecules with the halogens on the wall of the glass body. The centre line of the arc tube is defined as an imaginary axis which extends centrally in the glass body in the longitudinal direction of the glass body. The respective electrode end has a distance in the radial direction to the inner side of the wall in the glass body. This distance is preferably less than or equal to the length of the imaginary line between the electrode end and the region of the said transition in order to ensure that the greater quantity of metal atoms active within the region of the electrode end is prevented from diffusing through the thicker wall of the glass body in the end portion. A smaller quantity of metal atoms is active within the region of the middle portion during operation of the metal halogen lamp.

Alternatively, the middle portion of the glass body has a thickness of 0.6-1.0 mm, preferably 0.7-0.9 mm, and the respective end portion of the glass body has a thickness of 1.2-2.2 mm, preferably 1.6-1.8 mm.

A metal halogen lamp which is compact and which, at the same time, has a long working life has thus been produced.

Alternatively, the respective electrode end is arranged close to the end face or end wall of the arc tube inside the glass body.

By the total length of the glass body is meant the length which can be measured from end face to end face in the longitudinal direction of the arc tube. Alternatively, the length of the glass body corresponds to the length of the arc tube.

Preferably, the number of halogens is matched to the number of metal atoms in a ratio in which all halogens can form molecules with the metal atoms.

The excess of metal atoms which are free and which can diffuse through the wall of the glass tube is thereby minimized, which, in combination with the thicker end portions, produces a metal halogen lamp with long working life.

Alternatively, the glass body also contains zinc and zinc sulphide for the amplification of light, generated by the arc, through the thicker glass of the end portions.

The shielding of light due to the thicker wall in the end portions of the glass body is thus compensated. The impairment of the light intensity within the region of the end portions is therefore compensated by the admixture of zinc and zinc sulphide. Pure zinc has a very satisfactory refractive index, which increases the light intensity in the arc tube. Zinc sulphide exhibits phosphorescence, due to impurities, upon illumination with blue or ultraviolet light. Apart from the fact that the light intensity has been compensated to correspond to that of a traditional metal halogen lamp, the quantity of mercury can also be reduced in the arc tube, which is environmentally friendly. Likewise, the addition of zinc and zinc sulphide in the arc tube allows a reduction in the quantity of halogens, thereby reducing the risk that single halogens will not form stable molecules with the metal atoms. Single free halogens of this kind would otherwise be able to erode the wall of the glass body on the inner side, whereby any free metals would more easily diffuse out of the arc tube. Apart from compensating for the shielding of light due to the thicker end portions, the metal halogen lamp can therefore be produced with longer working life due to minimal erosion of the wall of the glass body.

Preferably, the glass body comprises ceramic glass. The glass body is advantageously made solely of ceramic glass.

The arc tube is thereby heat-resistant, transparent and has a high melting point. Ceramic glass has the advantage of being electrically insulating and is chemically stable. Ceramic glass, such as neoceramic glass, tolerates very high heat.

Alternatively, the glass body comprises quartz glass.

A glass body of the metal halogen lamp has thus been produced, which has the characteristic of letting through ultraviolet light.

BRIEF DESCRIPTION OF THE DRAWINGS

The invention will now be explained with reference to the drawing, in which, in schematic representation.

MODE(S) FOR CARRYING OUT THE INVENTION

Figure 1:
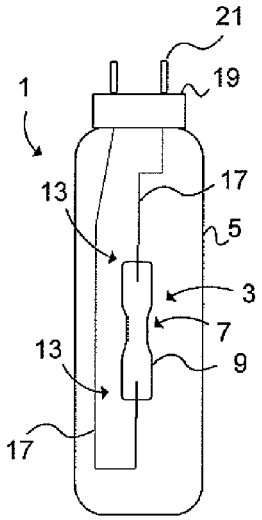
FIG. 1 shows a metal halogen lamp according to a first embodiment.

The invention will be described in detail below with the aid of particular embodiments thereof. For the sake of clarity, components of no importance to an explanation of the invention have been omitted from the drawing. The embodiments should not be seen as limiting the invention, but are merely examples.

FIG. 1 shows in schematic representation a metal halogen lamp 1 according to a first embodiment. The metal halogen lamp 1 has a light value of 75-90 Ra, preferably 80-85 Ra, with a colour temperature in this example of 3000-6000° K, preferably 4000-5000° K.

The metal halogen lamp 1 comprises an elongated arc tube 3 enclosed in a transparent glass casing 5. The arc tube 3 is made up of a hollow glass body 7 of ceramic glass and comprises two end portions 9 and a middle portion 11.

An electrode 13 is arranged on the respective end portion 9. The electrodes 13 also each have an electrode end 15. The electrodes 13 are connected by conductive rods 17 to a driver (not shown) in the cap 19 of the metal halogen lamp 1, which can be connected to a power source via connecting pins 21 arranged on the cap 19. During operation of the metal halogen lamp 1, an arc 23 (see FIG. 5*a*) is then generated between the electrode ends 15. The arc 23 generates a light in the glass body 7 of the arc tube 3, which glass body comprises a gas mixture. The gas mixture consists of mercury and argon and other substances which give the metal halogen lamp 1 its characteristics. The metal halogen lamp 1 is provided with the driver for ignition purposes and, according to this embodiment, gives an output of 50-70 W. The driver regulates the current through the arc tube 3 following the creation of a voltage pulse which starts the arc 23.

The other substances in the gas mixture, enclosed in the glass body 7, are above all halogens h and metal atoms m. Using the same working method as conventional fluorescent lamps, metal halogen lamps produce light by generating an electric arc (not shown) by means of the gas mixture. The switch of an igniter (not shown) switches off the current following ignition of the arc tube 3, whereupon a short high-voltage shock is given to the electrodes 13 in the end portions 9. A ballast (not shown) or coil is arranged in the cap 19 and forms part of an electric circuit (not shown) which is arranged there. The high voltage makes the gas mixture of the arc tube 3 ignite, and after that the arc tube 3 can be driven with lower voltage. When the arc tube 3 is in the working position and is alight, there is practically no resistance to the current. The ballast then limits the current to an appropriate value.

The gas of the arc tube 3 comprises a mixture of argon, mercury and various metal halogens under high pressure. The argon gas, which can easily be ionized, enables the formation of the electric arc when a current is generated across the electrodes 13. The heat which is then produced by the electric arc produces, in turn, vaporization of the mercury and metal halogens and light is generated as the pressure and the temperature in the arc tube 3 increase. The working principle for this will be described in greater detail below in connection with an explanation of FIGS. 5*a*-5*d*.

Figure 2:
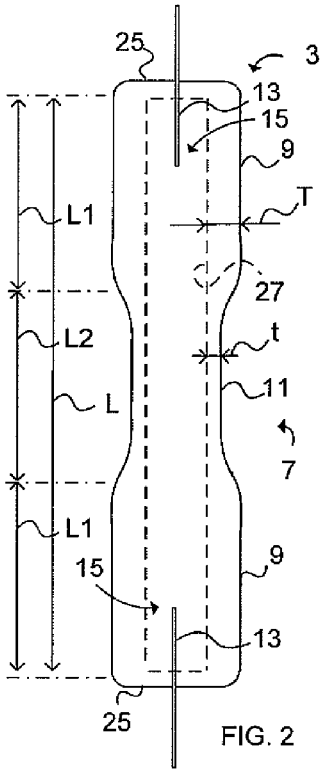
FIG. 2 shows an arc tube contained in the metal halogen lamp in FIG. 1.

The arc tube 3 has a wall thickness which is thicker on the end portions 9 than on the middle portion 11, the thicker end portions 9 each having a length L1 of at least one-third of the total length L of the arc tube 3, illustrated in greater detail in FIG. 2.

FIG. 2 shows in schematic representation the arc tube 3 contained in the metal halogen lamp 1 in FIG. 1. The electrodes 13 are each embedded in the end portions 9 on the respective end wall 25 of the glass body 7. The electrodes 13 comprise the electrode ends 15, which are each adjacent to the respective end wall 25. The glass body 7 has a thicker wall thickness on the end portions 9. The wall of the glass body is thicker on the end portions than on the middle portion. The length L1 of each end portion 9 accounts for one-third of the total length L of the glass body 7. The length L2 of the middle portion 11, comprising the thinner wall thickness, thus equates to one-third of the total length of the glass body 7.

The hollow glass body 7 is plane on its inner side 27 and the thickening of the glass walls of the end portions 9 is realized on the outer side of the glass body 7, as can clearly be seen from FIG. 2. The middle portion 11 of the glass body 7 has a wall thickness of 0.6-1.0 mm, preferably 0.7-0.9 mm, and the respective end portion 9 of the glass body 7 has a wall thickness of 1.2-2.2 mm, preferably 1.6-1.8 mm.

Figure 3:
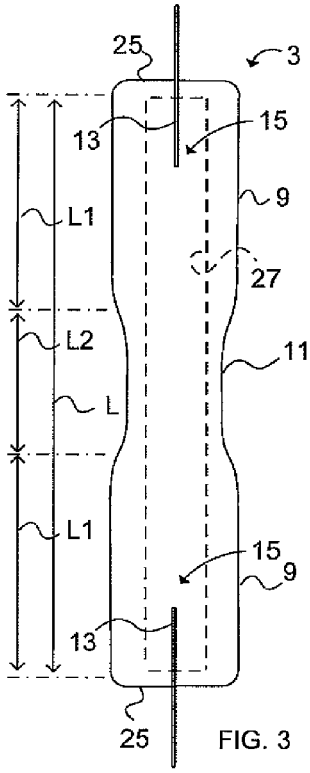
FIG. 3 shows an arc tube of a metal halogen lamp according to a second embodiment.

FIG. 3 shows an arc tube 3 of a metal halogen lamp 1 according to a second embodiment. According to this embodiment, the thicker glass walls of the end portions 9 extend with a length L1 longer than one-third of the length of the arc tube 3, namely two-fifths of the total length L of the arc tube 3 (glass body 7).

Active metal atoms and halogens, in which reference notations can be found in FIGS. 5*a*-5*d*, are hereinafter described with the following description. The Applicant has noted in experiments with a spectroscope that metal atoms m tend to diffuse through the wall of the glass body 7 primarily within the region of the end portions 9, since the electrodes 13 there act as anode/cathode. In theory, the metal atoms m are attracted during operation of the metal halogen lamp 1 to the anode side, which alternately varies between the two electrodes 13. The fact that the thicker glass wall projects quite a way over the electrode end 15 in the direction away from the placement of the electrode 13 in the arc tube 3 thus serves to ensure that any free metal atoms m not bonded with the halogens h are prevented in greater measure from diffusing out from the arc tube 3. Such detention of metal atoms m in the arc tube 3 allows the working life of the metal halogen lamp 1 to be extended in comparison to the prior art, since the metal atoms in are used to generate light according to the working principle described above.

In FIG. 3, the glass body 7 also comprises zinc and zinc sulphide in order to amplify the light which is generated by the arc 23. The thicker glass walls of the end portions 9 extend relatively far in the direction of the middle of the arc tube 3 (that is to say, viewed in the direction corresponding to the principal extent of the arc tube 3) and prevent some light from leaving the arc tube 3. Through the admixture of zinc and zinc sulphide, this shielding of light is compensated, whereby the metal halogen lamp 1 can burn with appropriate light. Pure zinc has a refractive index which amplifies the light intensity and zinc sulphide exhibits phosphorescence upon illumination with blue or ultraviolet light. In the arc tube 3 shown in FIG. 3, the quantity of mercury can also be reduced. Likewise, the addition of zinc and zinc sulphide in the arc tube 3 allows a reduction in the quantity of halogens h, thereby reducing the risk of single halogens h failing to form stable molecules and eroding the inner side of the glass wall in the glass body 7.

Figure 4:
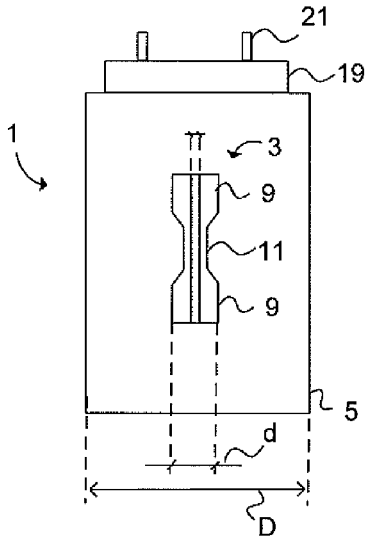
FIG. 4 shows the arc tube in FIG. 3 applied in a transparent casing of glass.

FIG. 4 shows in schematic representation the arc tube 3 in FIG. 3 applied in a glass transparent casing 5, forming the metal halogen lamp 1. A suitable underpressure is attained beneath the transparent casing 5 with heat-insulating gas.

FIGS. 5*a*-5*d* show the working principle for the arc tube 3 of the metal halogen lamp 1 shown in FIG. 1. The halogen cycle can be divided into four steps, which are apportioned in respective FIGS. 5*a*-5*d*. An arc 23 is generated between the respective electrode ends 15.

Figure 5A:
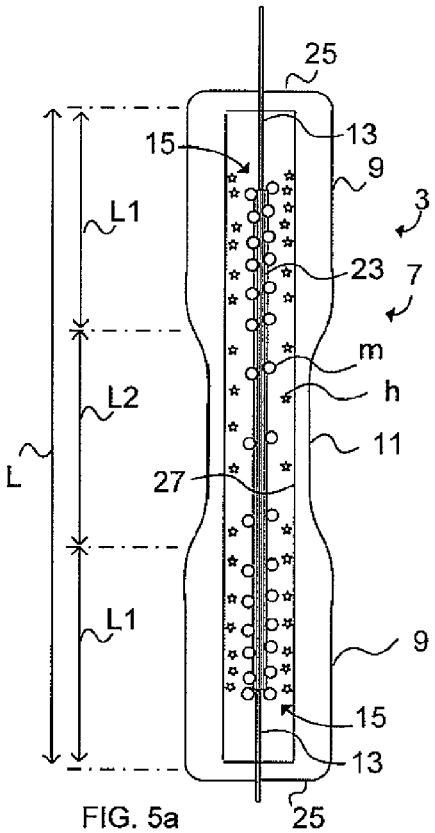
FIGS. 5*a*-5*d* show the working principle for the arc tube of the metal halogen lamp shown in FIG. 1.

FIG. 5*a* shows that metal atoms m during operation of the metal halogen lamp 1 (and under suitable operating conditions) start to move from the arc 23 in the direction of the inner side 27 of the glass body 7 of the colder arc tube 3 (which, during operation, is colder than the arc 23), on which inner side 27 halogens h released in this step are located.

Figure 5B:
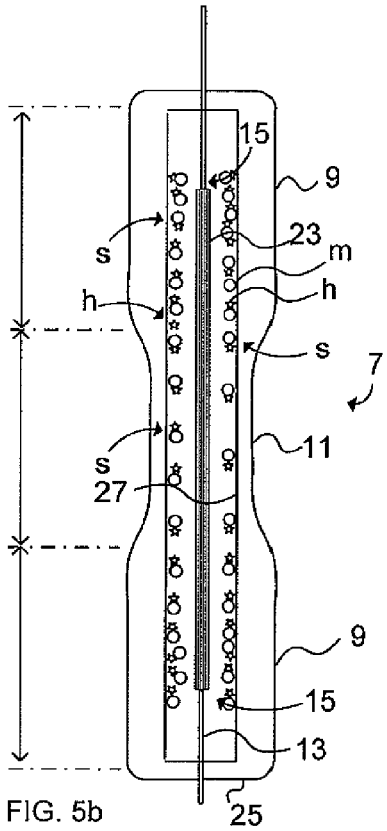

In the next step illustrated in FIG. 5*b*, it is shown that the metals m and the halogens h form stable molecules s on the said inner side 27 of the arc tube 3. These stable molecules s do not corrode the inner side 27 of the arc tube 3. The formation of the stable molecules s is realized by the vapour pressure formed during operation and by the increased temperature of the arc 23.

Figure 5C:
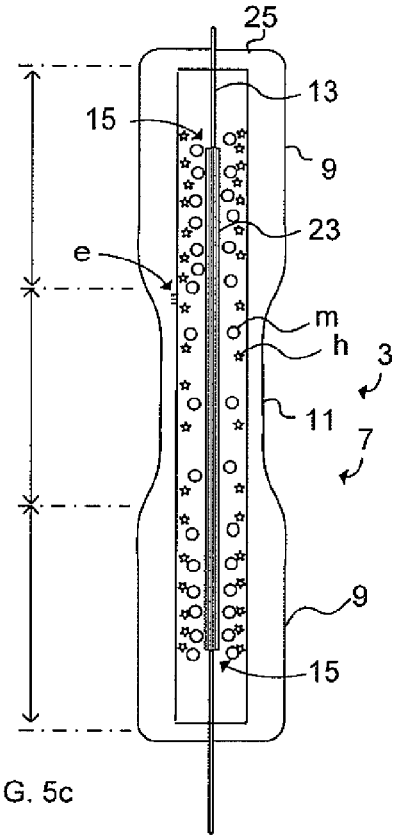
Figure 5D:
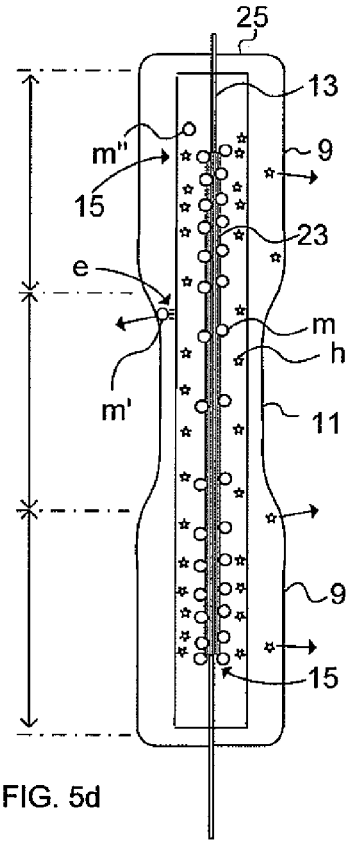

When the metal halogens m approach the arc 23 (see FIG. 5*c*), the molecules s are broken up, whereby the halogens h move away from the arc 23 and the metal atoms m remain in the arc 23 and generate light in a fourth step, see FIG. 5*d*. After this, the first step begins anew and the metal atoms m move from the arc 23 towards the halogens h on the inner side 23 to form stable molecules s.

In FIG. 5*b* is shown a halogen h which has failed to form a stable molecule s with a metal atom m due to the redundancy of the halogen h in an excess of halogens h in the arc tube 3. This halogen h erodes here a part of the inner side 27 of the glass body 7. As stated earlier, the activity of the metal atoms m and halogens h is greater within the region of the electrode end 15 (when this acts as an anode). In this example, the erosion thus takes place in the vicinity of the electrode end 15 and on the middle portion 11. The effect of the erosion on the ceramic glass of the glass body 7 is shown with the marking e in FIG. 5*c*.

The erosion in the vicinity of the electrode end 15 in the thicker end portion 9 does not significantly affect the characteristics of the arc tube 3 in terms of the transmission of metal atoms and is therefore not marked in FIG. 5*c*.

In FIG. 5*d* it is shown how, according to the fourth step, a metal atom m' moves out through the glass body 7 at the position of the said erosion at marking e, instead of being detained in the arc 23. By virtue of the thicker glass of the end portion 9, free metal atoms (see ref. m") thus tend to stay to a greater extent in the arc tube 3 than erode out from this.

The middle portion 11 with thinner wall thickness allows satisfactory light flux out through the arc tube 3 during operation and a minimal use of material during production, at the same time as a metal halogen lamp 1 with low weight and long burning time has been produced.

Figure 6:
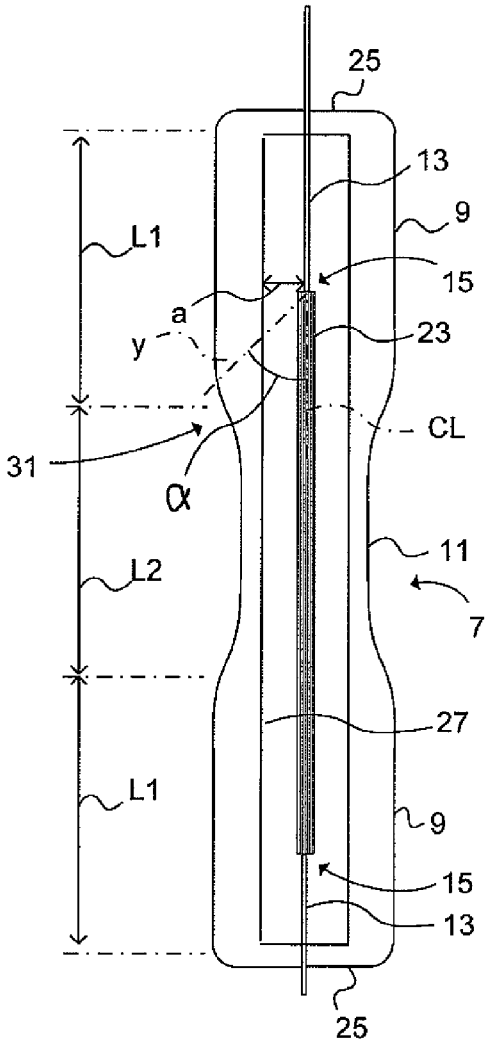
FIG. 6 shows an arc tube of a metal halogen lamp according to a third embodiment.

FIG. 6 shows in schematic representation an arc tube 3 of a metal halogen lamp 1 according to a third embodiment, in which the respective electrode end 15 is placed in such a way that an imaginary line y starting from the electrode end 15 intersects the region 31 of the transition between the end and middle portions 9, 11 at an angle $\alpha$ of 45 degrees relative to the centre line (CL) of the arc tube 3. The number of halogens h in the arc tube 3 is matched to the number of metal atoms m in a ratio in which all halogens h can form molecules with the metal atoms m. In this way, the excess of metal atoms which are free and which can otherwise diffuse through the wall of the glass body 7 is minimized, which, in combination with the thicker end portions 9, produces a metal halogen lamp 1 with a long working life.

Figure 7:
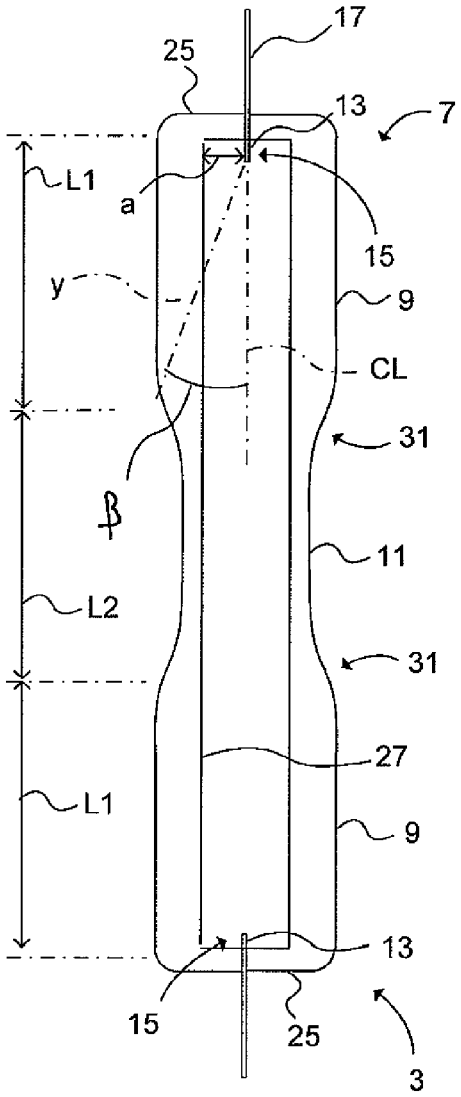
FIG. 7 shows an arc tube of a metal halogen lamp according to a fourth embodiment.

FIG. 7 shows in schematic representation an arc tube 3 of a metal halogen lamp 1 according to a further embodiment, in which the respective electrode end 15 is placed in such a way that an imaginary line y starting from the electrode end 15 intersects the region of the transition 31 between the end and middle portions 9, 11 at an angle $\gamma$ of 30 degrees relative to the centre line CL of the arc tube 3. The glass body 7 is made of quartz glass. Through this placement of the electrode end 15 well within the region of the transition 31 between the end portion 9 and the middle portion 11, conditions are created in the arc tube 3 which prevent any free metal atoms m from being able to diffuse out from the arc tube during operation, whereby the operating time of the metal halogen lamp 1 can be increased. Alternatively, the arc tube 3 can be produced in more compact form, with maintained operating time corresponding to that of a tradition metal halogen lamp.

The distance a (i.e. the distance in the radial direction between the inner side 27 and the electrode end 15) in FIGS. 6 and 7 is less than the distance between the electrode end 15 and the transition 31 between the end portion 9 and the middle portion 11.

The invention should not be seen to be limited by the above-described embodiments, but rather within the scope of the invention there are also other embodiments which likewise describe the inventive concept, or combinations of the embodiments which have already been described. For example, other gas mixtures than those which have been described can be used. The arc tube can be produced in materials other than ceramic glass or quartz glass. The end portions can have a gradually decreasing thickness without departing from the inventive concept.

The invention claimed is:

1. A metal halogen lamp comprising:

an elongated arc tube enclosed in a transparent casing, wherein the elongated arc tube is made up of a hollow glass body comprising two end portions and a middle portion, an electrode arranged on the respective end portions, which electrodes, each having an electrode end, upon connection to a power source and during operation of the metal halogen lamp, are operable to generate an arc between them;

wherein the glass body encloses halogens (h) and metal atoms (m) and has a wall thickness which is thicker on the end portions than on the middle portion, wherein the thicker end portions each have a length (LI) of at least one-third of the total length (L) of the arc tube, and wherein the respective electrode end is placed such that an imaginary line (y) between the electrode end and the region of the glass body defined by the transition between the end portion and the middle portion intersects the centre line (CL) of the arc tube at an angle of 25-50 degrees.

2. The metal halogen lamp according to claim 1, wherein the end portions each have a length (LI) of around 40% of the total length (L) of the arc tube.

3. The metal halogen lamp according to claim 1, wherein the inner side of the hollow glass body is plane and thickening of the end portions is realized on the outer side of the glass body.

4. The metal halogen lamp according to claim 1, wherein the middle portion of the glass body has a thickness of 0.6-1.0 mm, and the respective end portion of the glass body has a thickness of 1.2-2.2 mm.

5. A metal halogen lamp comprising:

an elongated arc tube enclosed in a transparent casing, wherein the elongated arc tube is made up of a hollow glass body comprising two end portions and a middle portion, an electrode arranged on the respective end portions, which electrodes, each having an electrode end, upon connection to a power source and during operation of the metal halogen lamp, are operable to generate an arc between them;

wherein the glass body encloses halogens (h) and metal atoms (m) and has a wall thickness which is thicker on the end portions than on the middle portion, wherein the thicker end portions each have a length (LI) of at least one-third of the total length (L) of the arc tube, and wherein the number of halogens (h) is matched to the number of metal atoms (m) in a ratio in which all halogens (h) can form molecules (s) with the metal atoms (m).

6. A metal halogen lamp comprising:

an elongated arc tube enclosed in a transparent casing, wherein the elongated arc tube is made up of a hollow glass body comprising two end portions and a middle portion, an electrode arranged on the respective end portions, which electrodes, each having an electrode end, upon connection to a power source and during operation of the metal halogen lamp, are operable to generate an arc between them;

wherein the glass body encloses halogens (h) and metal atoms (m) and has a wall thickness which is thicker on the end portions than on the middle portion, wherein the thicker end portions each have a length (LI) of at least one-third of the total length (L) of the arc tube, and wherein the glass body also contains zinc and zinc sulphide for the amplification of light, generated by the arc, through the thicker glass of the end portions.

7. The metal halogen lamp according to claim 1, wherein the glass body comprises ceramic glass.

8. The metal halogen lamp according to claim 1, wherein the glass body comprises quartz glass.

* * * * *